United States Patent [19]

Lamlee

[11] 4,171,807

[45] Oct. 23, 1979

[54] BILLIARD GAME

[76] Inventor: Stewart Lamlee, 55 W. 86th St., New York, N.Y. 10024

[21] Appl. No.: 780,081

[22] Filed: Mar. 22, 1977

[51] Int. Cl.[2] ..... A63D 15/00

[52] U.S. Cl. ..... 273/3 A; 273/8; 273/126 R; 273/DIG. 26

[58] Field of Search ..... 273/126 R, 126 A, 118 R, 273/118 A, 113, 115, 116, 119 R, 119 A, 121 R, 121 A, 121 D, 121 E, 122 R, 122 A, 123 R, 123 A, 124 R, 124 A, 125 R, 125 A, 127 R, 127 B, 127 C, 85 R, 3 A, 8, 9; D34/5 SS

[56] References Cited

U.S. PATENT DOCUMENTS

| | | | |
|---|---|---|---|
| 98,084 | 1/1906 | Osbrink | D34/5 SS |
| 1,092,006 | 3/1914 | Bailey | 273/3 R |
| 1,265,761 | 5/1918 | Brent et al. | 273/126 R |
| 1,641,525 | 9/1927 | Boessow | 273/9 |
| 1,945,798 | 2/1934 | Barry | 273/121 R |
| 2,182,418 | 12/1939 | Williams | 273/121 A |
| 3,815,911 | 6/1974 | Cooper | 273/108 |
| 3,963,241 | 6/1976 | Meyer | 273/121 R |
| 3,979,119 | 9/1976 | Cecchetti | 273/121 R |

FOREIGN PATENT DOCUMENTS

| | | | |
|---|---|---|---|
| 600623 | 11/1925 | France | 273/121 R |

*Primary Examiner*—Richard C. Pinkham
*Assistant Examiner*—T. Brown
*Attorney, Agent, or Firm*—Brian L. Ribando

[57] ABSTRACT

A playing surface for a billiard type of game comprises three straight ball rebound sides and one parabolic ball rebound side extending upwardly, inwardly and around the periphery of the playing surface. The playing surface and all sides have a nap or felt covering. A number of fixed obstacles on the surface are located at strategic locations to compound playing difficulty. Counting discs are threaded to rails outside of the playing surface, attached to the rebound sides and are used to keep score.

3 Claims, 5 Drawing Figures

BILLIARD GAME

BACKGROUND OF THE INVENTION

This invention relates to improvements in game tables on which a game similar to billiards may be played with balls on a cushioned surface.

Billiard like games are old and well known in the art. Such games and the apparatus therefor are a constant source of amusement and challenge for game participants. While the most common form of billiard table is rectangular, other forms have been disclosed. The patent to Arney, U.S. Pat. No. 803,520, shows a five-sided game table having the shape of a regular polygon. The design patent to Cannon D 86,218 shows a six-sided game table having an elongated hexagonal shape. Rectangular game tables having one side of a normal rectangle substituted by two angularly related sides are also known in the art. Such tables are disclosed by Snedaker in U.S. Pat. No. 928,160, Lee in U.S. Pat. No. 1,693,116, and Trost in U.S. Pat. No. Des. 66,386. A further alteration of the normally rectangular billiard game table is shown by Reesch in U.S. Pat. No. 208,539 wherein an elliptically shaped table is disclosed.

SUMMARY OF THE INVENTION

The table of the present invention has a generally rectangular shape with the exception that a parabola is substituted for one of the sides. The parabola adds interest and challenge to games played on the table in that the path of a ball or other object ricocheting off the parabolic side is difficult to forsee. Additionally, fixed obstacles on the table provide surfaces off from which the game pieces may rebound. These obstacles are located along the perimeter of the table as well as in the central playing area. The playing surface itself has a felt-like finish, as do bumper edges which form the perimeter. Counting discs threaded on rails outside of the playing surface are used for keeping score during game play. These and other aspects of the invention will be apparent from the following description taken in conjunction with the several drawing figures.

DESCRIPTION OF THE PREFERRED EMBODIMENT

Figure 1:
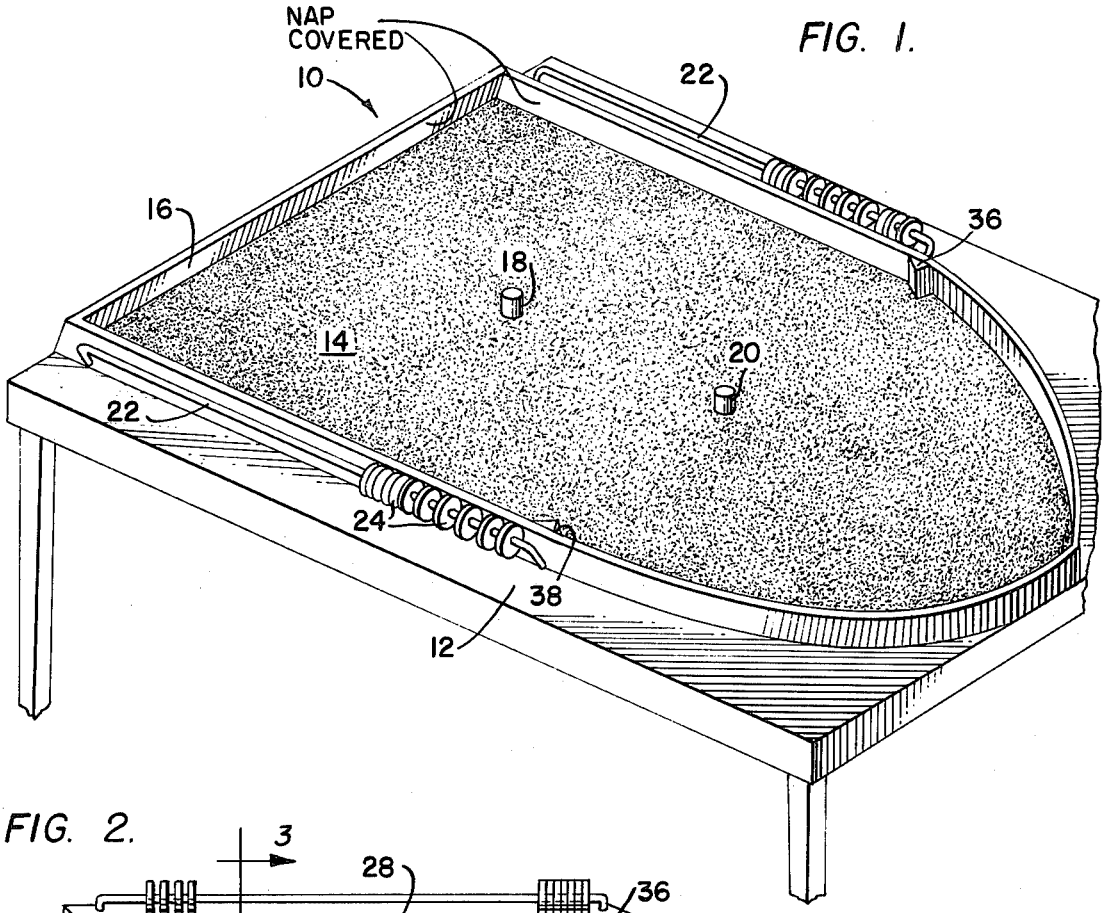
FIG. 1 is a perspective view of the device in position for play on a supporting surface.

Referring first to FIG. 1, there can be seen generally the game table 10 resting on a supporting surface 12. It will be understood that the supporting surface 12 forms no part of the present invention and is shown here only as a convenient and ordinary means of support for the table 10 in playing position. The game table 10 comprises a main playing surface 14 bounded around its perimeter by walls 16. Within the central area of the playing surface 14 are two fixed obstacles 18 and 20. Located outside of the playing area are two rails 22 located on opposite sides of playing surface 14. Threaded onto these rails 22 are a plurality of counting discs 24. Equal numbers of counting discs are provided on each of the two rails 22.

Figure 2:
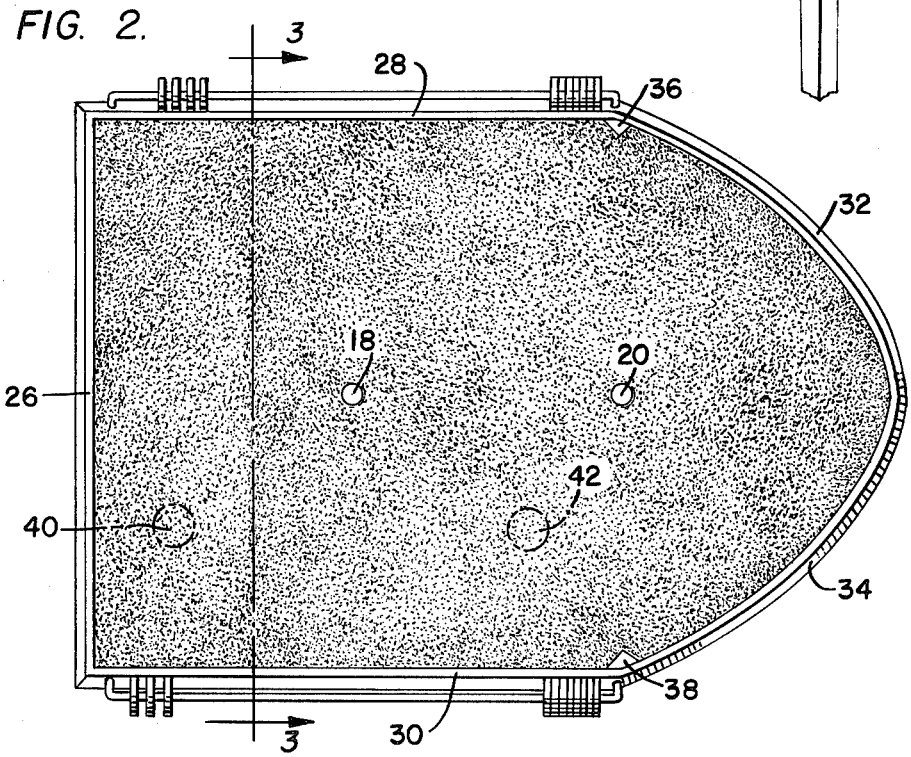
FIG. 2 is a plan view of the device.

Turning now to FIG. 2, it can be clearly seen that the walls 16 which define the perimeter of the playing surface 14 comprise three straight wall sections 26, 28 and 30, and two curved wall sections 32 and 34. The wall sections 26 and 28 meet at approximately a 90° angle and the wall sections 26 and 30 meet at approximately a 90° angle. Where these angles are exactly 90°, sides 28 and 30 are parallel to one another. The wall sections 32 and 34 are curved in the preferred embodiment and are parabolic in shape. The focus of this parabolic shape is along the line which connects obstacles 18 and 20 on the central playing area. It will be seen that two additional fixed obstacles 36 and 38 are located along the perimeter of the playing area. These obstacles are preferably at the intersections of the ends of the parallel sides 28 and 30 with the ends of the parabolic sides 32 and 34, respectively. Two balls 40 and 42 are shown on the playing surface. It will be seen that the counting discs 24 may be slid along the rails 22 for scoring purposes during game play.

Figure 3:
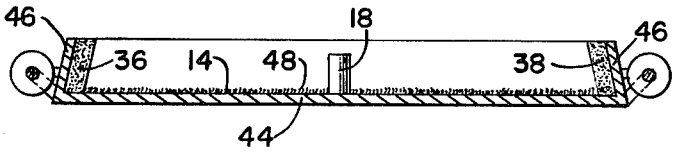
FIG. 3 is a sectional view taken along lines 3—3 of FIG. 2 showing the playing surface, the perimeter walls, and the counting discs.

Turning now to FIG. 3, some of the constructional features of the invention can be more readily seen. The playing surface 14 and the perimeter defining walls 16 are seen as comprising a shell 44 with attached inclined sidewalls 46. This shell with the sidewalls may be made of plastic and vacuum formed into the required configuration. Other materials, such as metal or a wood-like product, may be used in which instances the attachment of the walls to the playing surface will be effected by means compatible with the particular material used. The shell 44, the walls 46 and the obstacles 18, 20, 36 and 38 are covered with a nap or felt-like layer 48. This layer gives the desired rolling resistance to the balls which are used in game play. The inward inclination of the perimeter walls provides the desired rebound or bounce for the balls after contact therewith.

Having now described the game apparatus, a typical game which may be played therein is as set forth below. The game is played by two players, each of whom has a different colored ball. The object of the game is to strike one's own ball so that it strikes an opponent's ball after having rebounded off from a wall or an obstacle. Each time a player is able to accomplish this, a point is scored, and that player is given another turn. It will be appreciated that while a rebound from one of the straight walls is not too difficult to predetermine, the curved walls compound the difficulty in trying to strike an opponent's ball. The eventual path of a player's ball may be further influenced by the fixed obstacles both in the central playing area and along the sides.

The scoring discs are used to keep the player's score, and the first player to score eleven points wins. Compensation for players of unequal proficiency in game play may be made by requiring the more accomplished player to rebound his ball twice from a wall or obstacle before his opponent's ball may be struck.

Figure 4:
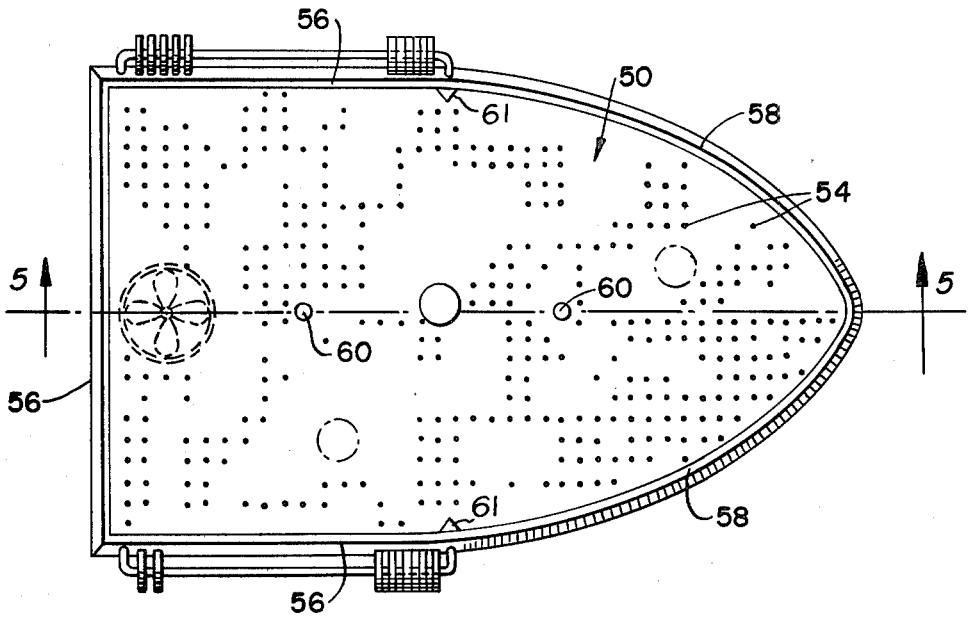
FIG. 4 is a plan view of an alternative embodiment of the device.
Figure 5:
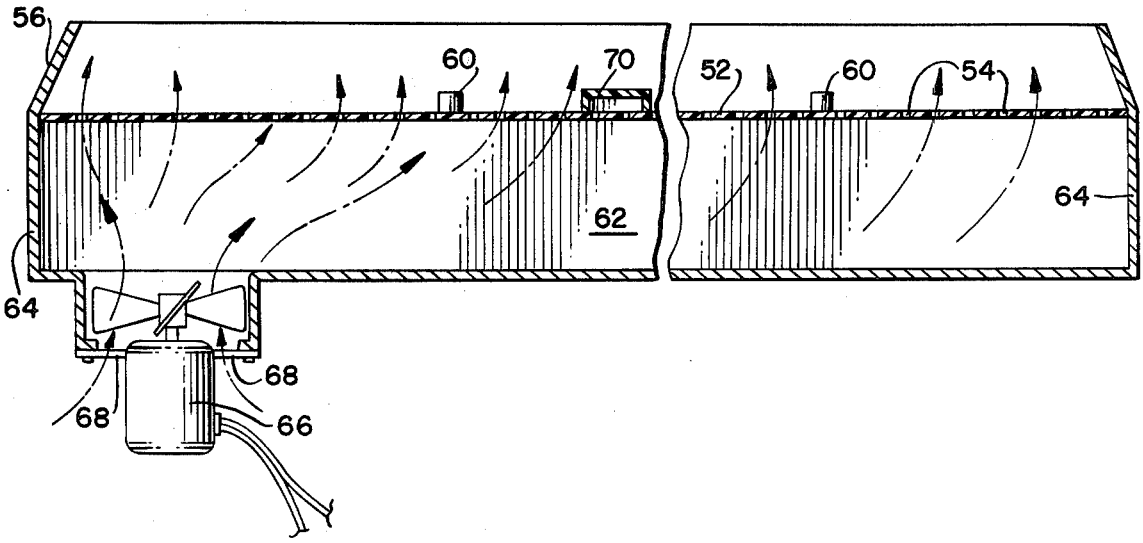
FIG. 5 is a sectional view taken along line 5—5 of FIG. 4 showing a perforated playing surface above an air plenum chamber.

Turning now to FIGS. 4 and 5, an alternative embodiment is shown in which a playing surface 50 is provided and comprises a sheet of smooth rigid material 52, such as plastic, in which is formed an array of pinholes 54. Side walls comprising straight walls sections 56 and parabolic wall sections 58 surround the playing surface and fixed obstacles 60 and 61 are attached thereto. A plenum chamber 62 is formed beneath the playing surface 50 by lower walls 64 which follow the perimeter outline of the playing surface and bottom wall 65. An electric fan 66 supplies air by way of inlets 68 to the chamber 62. Air which is forced into chamber 62 escapes by way of pinholes 54 and provides a buoyant cushion for a puck 70 resting on the surface 50. The portion of the puck 70 which is resting on the surface 50 is cup-shaped and this shape aids in collecting air released through the pinholes 54. The collected air reduces the sliding friction which would otherwise severly retard a sliding motion of the puck 70 across the surface 50. By way of example only, the spacing between adjacent holes 54 can be 1" and the diameter of the puck can be 2" thus insuring that at any position on the playing surface, the puck is capturing air released from several of the holes 54. Games which can be played with the device of FIGS. 4 and 5 are similar to those which can be played with the device of FIGS. 1–4. It will be appreciated that the air escaping from the plenum 62 and captured by the puck 70 allows the puck to respond to an impact with a reaction which is smooth snd unimpeded, while at the same time being snappy.

Having thus described the invention, variations in the game apparatus and in game play will occur to those skilled in the art and these variations are intended to be within the scope of the invention as defined in the appended claims.

I claim:

1. A billiard game board for use in playing a billiard game including billiard balls, the billiard game board comprising:

a flat surface comprising a level horizontal playing surface for billiards, three straight sides and one curved side bounding said horizontal playing surface, two of said straight sides being parallel, said curved side being parabolic in shape and joining said two parallel straight sides, said third straight side joining said parallel sides, said four sides all being inclined inward toward the center of said flat surface to comprise rebound means for said billiard balls after contact therewith, first fixed obstacles attached to said flat surface along the line of focus of said parabolic side, second fixed obstacles attached to said surface at the joinder of said curved parabolic side and said two parallel sides, and a nap covering said flat surface and said inclined sides for providing rolling resistance to said billiard balls.

2. The apparatus of claim 1 wherein:

a first rail is located along one of said parallel sides;

a plurality of discs are slidably attached to said first rail;

a second rail is located along the second of said parallel sides; and a plurality of discs are slidably attached to said second rail.

3. The apparatus of claim 1 wherein:

said surface and said inclined sides comprise vacuum formed plastic.

* * * * *